US006942005B2

(12) United States Patent
Le Gette et al.

(10) Patent No.: US 6,942,005 B2
(45) Date of Patent: Sep. 13, 2005

(54) SELF-OPENING ENCLOSURE

(75) Inventors: Brian Edward Le Gette, Baltimore, MD (US); Alan Tipp, Baltimore, MD (US); Justin Saul Werner, Millersville, MD (US); Ronald L. Wilson, II, Catonsville, MD (US)

(73) Assignee: Kelsyus, LLC, Virginia Beach, VA (US)

( * ) Notice: Subject to any disclaimer, the term of this patent is extended or adjusted under 35 U.S.C. 154(b) by 0 days.

(21) Appl. No.: 10/621,582

(22) Filed: Jul. 18, 2003

(65) Prior Publication Data

US 2004/0016521 A1 Jan. 29, 2004

Related U.S. Application Data

(63) Continuation of application No. 09/764,059, filed on Jan. 19, 2001, now Pat. No. 6,595,227.

(51) Int. Cl.[7] ..... A47H 13/00

(52) U.S. Cl. ..... 160/368.1; 160/370.21; 160/405

(58) Field of Search ..... 160/368.1, 370.21, 160/370.22, 370.23, 351, 329, 405

(56) References Cited

U.S. PATENT DOCUMENTS

| | | | |
|---|---|---|---|
| 368,206 A | 8/1887 | Hardy | |
| 722,801 A | 3/1903 | Bourne, Jr. | |
| 1,047,163 A | 12/1912 | Bullock | |
| 1,479,903 A | 1/1924 | Erland | |
| 2,036,033 A | 3/1936 | Fisher | |
| 2,109,881 A | 3/1938 | Goldberg | |
| 2,190,566 A | 2/1940 | Julian | |
| 2,243,982 A | 6/1941 | Seeley | |
| 2,266,853 A | 12/1941 | Dabney | |
| 2,344,010 A | 3/1944 | Walsh | |

(Continued)

FOREIGN PATENT DOCUMENTS

| | | | | |
|---|---|---|---|---|
| EP | 202862 | * | 11/1986 | ..... 160/368.1 X |
| EP | 0 928 865 A1 | | 7/1999 | |
| EP | 0 974 293 A2 | | 1/2000 | |
| EP | 1 043 049 A2 | | 10/2000 | |
| JP | 3-21779 | | 1/1991 | |
| WO | WO 96/18789 | * | 6/1996 | ..... 160/368.1 X |

OTHER PUBLICATIONS

"The Undercover Sunshade," Delta, U.S.A., black and white photograph of advertisement packaging.

*Primary Examiner*—Bruce A. Lev
(74) *Attorney, Agent, or Firm*—Cooley Godward LLP

(57) ABSTRACT

A shade includes a frame member being formed from a flexible twistable material and a membrane. The shade includes a strap coupled to two ends of the membrane.

13 Claims, 17 Drawing Sheets

U.S. PATENT DOCUMENTS

| | | | | | |
|---|---|---|---|---|---|
| 2,357,789 | A | | 9/1944 | Levy | |
| 2,442,105 | A | | 5/1948 | Vacheron | |
| 2,637,861 | A | | 5/1953 | Kethledge | |
| 2,731,997 | A | | 1/1956 | Muth et al. | |
| 2,870,464 | A | | 1/1959 | Lalick | |
| 2,874,385 | A | | 2/1959 | Wade | |
| 2,875,771 | A | | 3/1959 | Brewin | |
| 2,932,833 | A | | 4/1960 | Wambach | |
| 2,961,802 | A | | 11/1960 | Mongan et al. | |
| 3,052,895 | A | | 9/1962 | Lo Vico | |
| 3,255,467 | A | | 6/1966 | Kowalski | |
| 3,336,610 | A | | 8/1967 | Geddings | |
| D210,181 | S | | 2/1968 | Solomon | |
| 3,640,296 | A | | 2/1972 | Huddle | |
| 3,675,667 | A | | 7/1972 | Miller | |
| 3,717,888 | A | | 2/1973 | Phelan | |
| 3,761,131 | A | * | 9/1973 | Oliver | 297/452.16 |
| 3,780,379 | A | | 12/1973 | Kampman | |
| 3,840,919 | A | | 10/1974 | Middleton | |
| 3,862,876 | A | | 1/1975 | Graves | |
| 3,899,853 | A | | 8/1975 | Wertman | |
| 3,899,854 | A | * | 8/1975 | Huddle | 52/81.2 |
| 3,960,161 | A | | 6/1976 | Norman | |
| 3,990,463 | A | | 11/1976 | Norman | |
| 4,068,674 | A | | 1/1978 | Mitchell | |
| 4,097,944 | A | | 7/1978 | Yulish | |
| 4,122,847 | A | | 10/1978 | Craig | |
| 4,200,942 | A | | 5/1980 | Case | |
| 4,231,125 | A | | 11/1980 | Tittl | |
| 4,232,692 | A | | 11/1980 | Atkins | |
| 4,236,543 | A | | 12/1980 | Moss | |
| D261,407 | S | | 10/1981 | Moss | |
| D261,464 | S | | 10/1981 | Smith | |
| 4,296,788 | A | | 10/1981 | Slater | |
| 4,440,187 | A | | 4/1984 | Fiddler | |
| 4,512,049 | A | | 4/1985 | Henry | |
| 4,531,330 | A | | 7/1985 | Phillips | |
| 4,561,480 | A | | 12/1985 | Underwood et al. | |
| 4,599,754 | A | | 7/1986 | Mairs, III et al. | |
| D287,041 | S | | 12/1986 | Gitchel et al. | |
| 4,641,379 | A | | 2/1987 | Martin | |
| 4,644,588 | A | | 2/1987 | Zawacki | |
| D288,613 | S | | 3/1987 | James et al. | |
| 4,646,770 | A | | 3/1987 | Lobato | |
| D292,438 | S | | 10/1987 | Lyke | |
| 4,709,430 | A | | 12/1987 | Nicoll | |
| 4,739,784 | A | | 4/1988 | Fast | |
| 4,785,838 | A | | 11/1988 | Negahdari | |
| 4,815,784 | A | | 3/1989 | Zheng | |
| 4,821,353 | A | | 4/1989 | Neri | |
| 4,825,892 | A | | 5/1989 | Norman | |
| 4,858,634 | A | | 8/1989 | McLeese | |
| 4,865,381 | A | | 9/1989 | Van Rogue | |
| 4,876,829 | A | | 10/1989 | Mattick | |
| 4,881,565 | A | | 11/1989 | Turk | |
| D306,762 | S | | 3/1990 | Aquino | |
| D307,338 | S | | 4/1990 | Vandeputte | |
| 4,915,120 | A | | 4/1990 | Ziolkowski | |
| 4,951,333 | A | | 8/1990 | Kaiser et al. | |
| 4,969,500 | A | | 11/1990 | Makosa | |
| 5,024,262 | A | | 6/1991 | Huang | |
| D318,706 | S | | 7/1991 | Norman | |
| 5,038,812 | A | | 8/1991 | Norman | |
| 5,056,172 | A | | 10/1991 | Kaiser et al. | |
| 5,059,463 | A | | 10/1991 | Peters | |
| D326,134 | S | | 5/1992 | Norman | |
| 5,116,273 | A | | 5/1992 | Chan | |
| 5,116,288 | A | | 5/1992 | Kondo et al. | |
| 5,135,281 | A | | 8/1992 | Pappalardo | |
| 5,137,044 | A | | 8/1992 | Brady | |
| 5,163,192 | A | | 11/1992 | Watson | |
| 5,163,461 | A | | 11/1992 | Ivanovich et al. | |
| 5,213,147 | A | | 5/1993 | Zheng | |
| D340,549 | S | | 10/1993 | Russell | |
| D341,407 | S | | 11/1993 | McLeese | |
| 5,313,666 | A | | 5/1994 | Bax et al. | |
| 5,320,405 | A | | 6/1994 | Foster et al. | |
| D349,593 | S | | 8/1994 | Hensley | |
| 5,345,627 | A | | 9/1994 | Cammarata | |
| 5,356,191 | A | * | 10/1994 | Sheehan | 296/95.1 |
| 5,385,165 | A | | 1/1995 | Hazinski et al. | |
| 5,396,917 | A | | 3/1995 | Hazinski et al. | |
| 5,403,220 | A | | 4/1995 | Goad, Sr. | |
| 5,411,046 | A | | 5/1995 | Wan | |
| 5,427,381 | A | | 6/1995 | Macaluso et al. | |
| 5,433,433 | A | | 7/1995 | Armell | |
| 5,435,025 | A | | 7/1995 | Gerard et al. | |
| 5,439,017 | A | | 8/1995 | Brown | |
| 5,439,018 | A | | 8/1995 | Tsai | |
| 5,452,934 | A | | 9/1995 | Zheng | |
| 5,454,643 | A | | 10/1995 | Sullivan | |
| 5,467,794 | A | | 11/1995 | Zheng | |
| 5,533,653 | A | | 7/1996 | Kaufman | |
| D374,512 | S | | 10/1996 | Kiley et al. | |
| 5,560,385 | A | | 10/1996 | Zheng | |
| 5,569,094 | A | | 10/1996 | Macaluso | |
| 5,579,799 | A | | 12/1996 | Zheng | |
| 5,592,961 | A | | 1/1997 | Chin | |
| 5,601,105 | A | | 2/1997 | Blen et al. | |
| 5,611,380 | A | * | 3/1997 | Landy | 160/76 |
| 5,618,110 | A | | 4/1997 | Sullivan | |
| 5,618,246 | A | | 4/1997 | Zheng | |
| D379,487 | S | | 5/1997 | Gale | |
| 5,629,071 | A | | 5/1997 | Feldman | |
| 5,632,318 | A | * | 5/1997 | Wang | 160/370.21 |
| 5,638,852 | A | | 6/1997 | Dean | |
| RE35,571 | E | | 7/1997 | McLeese | |
| 5,642,750 | A | | 7/1997 | Brown et al. | |
| 5,644,807 | A | | 7/1997 | Battistella | |
| 5,645,096 | A | | 7/1997 | Hazinski et al. | |
| D384,382 | S | | 9/1997 | Armell | |
| 5,664,596 | A | | 9/1997 | Zheng | |
| 5,676,168 | A | | 10/1997 | Price | |
| 5,688,052 | A | | 11/1997 | Compton | |
| 5,690,134 | A | | 11/1997 | McCauley | |
| 5,693,398 | A | | 12/1997 | Granger | |
| 5,722,446 | A | | 3/1998 | Zheng | |
| 5,730,529 | A | | 3/1998 | Fritz et al. | |
| 5,730,666 | A | | 3/1998 | Hudson | |
| 5,769,022 | A | | 6/1998 | Luxford | |
| 5,778,915 | A | | 7/1998 | Zheng | |
| 5,800,067 | A | | 9/1998 | Easter | |
| 5,816,278 | A | | 10/1998 | Kim | |
| 5,816,279 | A | | 10/1998 | Zheng | |
| 5,816,954 | A | | 10/1998 | Zheng | |
| 5,823,217 | A | | 10/1998 | Rice | |
| D400,949 | S | | 11/1998 | Gale | |
| 5,833,310 | A | | 11/1998 | Labelle | |
| D401,983 | S | | 12/1998 | Lowenthal | |
| 5,842,940 | A | | 12/1998 | Macaluso | |
| 5,845,697 | A | * | 12/1998 | Zheng | 160/370.21 |
| D412,354 | S | | 7/1999 | Takos | |
| 5,927,311 | A | | 7/1999 | Jager | |
| 5,941,265 | A | | 8/1999 | Zheng | |
| 5,950,649 | A | | 9/1999 | Gerig | |
| 5,976,023 | A | | 11/1999 | Cho | |
| 5,987,822 | A | | 11/1999 | McNiff et al. | |
| 5,989,130 | A | | 11/1999 | Macaluso | |
| 5,992,045 | A | * | 11/1999 | Kellogg et al. | 34/442 |
| D425,958 | S | | 5/2000 | DePasquale | |
| 6,062,243 | A | | 5/2000 | Tuch et al. | |

D426,415 S 6/2000 Le Gette et al.
6,073,283 A 6/2000 Zheng
6,095,172 A 8/2000 Trapp et al.
6,098,349 A 8/2000 Zheng
6,109,281 A 8/2000 Lowenthal
6,109,282 A 8/2000 Yoon
6,192,635 B1 2/2001 Zheng
6,199,229 B1 3/2001 Wong
6,220,264 B1 * 4/2001 Newman ..... 135/90
6,260,306 B1 7/2001 Swetish et al.
6,312,343 B1 11/2001 Cho
6,319,145 B1 11/2001 Coughlan
6,343,391 B1 2/2002 Le Gette et al.
6,349,732 B1 2/2002 Cooper
6,478,038 B1 * 11/2002 Le Gette et al. ..... 135/96
6,595,227 B2 * 7/2003 Le Gette et al. ..... 135/126
6,648,396 B2 * 11/2003 Monahan et al. ..... 296/97.7
6,685,276 B2 * 2/2004 Kenion ..... 301/37.103
2003/0222484 A1 * 12/2003 Gette et al. ..... 297/16.2

* cited by examiner

SELF-OPENING ENCLOSURE

CROSS-REFERENCE TO RELATED PATENT APPLICATION

This application is a continuation of application Ser. No. 09/764,059, filed Jan. 19, 2001, now U.S. Pat. No. 6,595, 227.

This patent application is related to commonly assigned U.S. patent application Ser. No. 09/229,968, entitled "Towel-Mat With a Frame Member and Removably Attached Membranes", filed Jan. 14, 1999, and which is incorporated by reference herein.

BACKGROUND OF THE INVENTION

This invention relates generally to a shade having multiple configurations, and in particular, to a shade that self-opens into an extended configuration, and also can be in a collapsed position and a curved configuration.

Conventional sunshades are typically used, for example, to provide shade from the sun while a person rests or lies in the sun. Difficulty exists, however, in adjusting the shape and the position of the sunshades when being used for such purposes. For example, conventional sunshades cannot easily be adjusted to provide shade as the sun changes position.

The need exists for a sunshade that can be easily adjusted to provide various configurations of shade and coverage to a user.

SUMMARY OF THE INVENTION

A shade includes a frame member being formed from a flexible twistable material and a membrane. The shade includes a tension member coupled to two ends of the membrane. In one embodiment, the tension member is a strap that includes coupling mechanisms that enable the length of the strap to be adjusted.

In one embodiment, the shade has an open or extended configuration. When the coupling mechanisms of the strap are coupled together, the strap length is shortened and the ends of the shade are brought closer together. In this arrangement, the shade has a curved configuration. The shade can also be folded from an extended configuration and a curved configuration into a collapsed configuration.

In one embodiment, the shade includes an extension member and a retention or anchor member that can be anchored into the ground or sand using a stake. The extension member is pulled rearwardly of the shade to adjust the angle at which the shade is tilted.

In an alternative embodiment, the shade includes two additional sets of extension members and anchor members that are pulled forwardly (or anchored straight down) in front of the shade to anchor the shade when a towel or other article is not positioned on the strap.

DETAILED DESCRIPTION OF THE INVENTION

A shade includes a flexible twistable material, a membrane, and a tension member. The flexible twistable material forms a frame member. The membrane has a perimeter portion to which the frame member is fixedly attached.

The term "membrane" is used herein to include, but is not limited to, a layer of material. For example, the member can be a piece of fabric such as nylon or neoprene. The term "perimeter portion" is used herein to include an area substantially about the perimeter of a membrane. The perimeter portion can be, for example, twenty percent of the membrane area nearest to the membrane perimeter.

Figure 1:
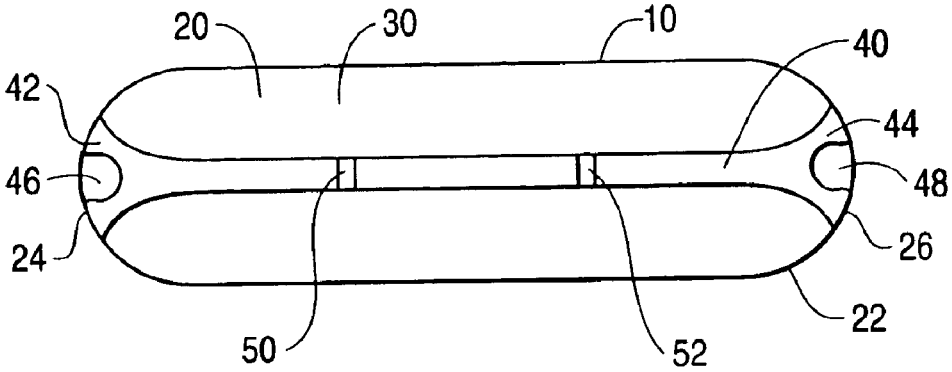
FIG. 1 illustrates a top view of a shade according to an embodiment of the invention.
Figure 2:
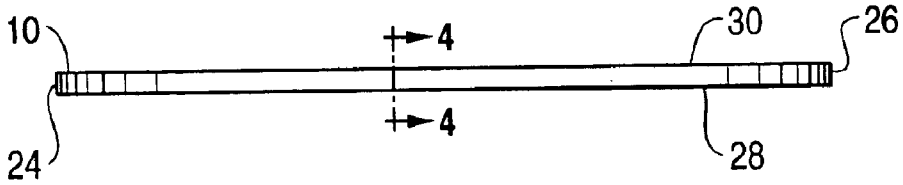
FIG. 2 illustrates a side view of the shade of FIG. 1.
Figure 3:
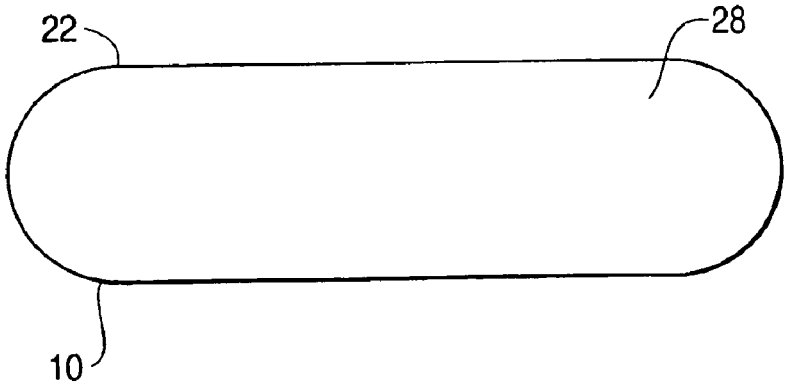
FIG. 3 illustrates a bottom view of the shade of FIGS. 1 and 2.

A shade according to an embodiment of the invention is illustrated in FIGS. 1–3. FIG. 1 illustrates a bottom view of the shade 10 while in an extended configuration. The shade 10 includes a membrane 20 and a tension member 40 that is connected to the membrane 20. The membrane 20 has a perimeter edge 22 and two ends 24, 26. The tension member 40 is connected to the ends 24, 26 of the membrane 20. The tension member 40 holds the membrane 20 in a particular configuration.

The membrane 20 includes an outer surface 28 and an inner surface 30 as shown in FIG. 2. A company logo or other indicia can be provided, for example, on the outer and/or inner surfaces.

In conventional devices, a large mat with wire frames is coupled to the ends of an upstanding frame. The wire frames and the amount of material in the mat provide a lot of bulk when the device is folded. Accordingly, the devices cannot be collapsed into a small, compact article.

In the illustrated embodiment, the tension member 40 is an elongate fabric strap. Alternatively, the strap can be a rope, cord, webbing, or any other structure that can provide a tensile force. A tension member according to an embodiment of the invention is elongate and narrow, thereby reducing the amount of material that is folded when the shade 10 is collapsed. A tension member according to an embodiment of the invention does not have a wire frame or other supporting structure. Accordingly, the tension member is flexible and easily collapsible.

The strap 40 includes ends 42, 44 which are coupled to membrane ends 24, 26, respectively. The strap 40 also has coupling mechanisms 50, 52 mounted thereto. Coupling mechanisms 50, 52 can be connected together to change the length of the strap 40, as described in greater detail below.

In the illustrated embodiment, the coupling mechanisms 50, 52 are mating hook and loop fasteners. Alternatively, buckles, clips, hooks, or any other coupling mechanisms can be used to vary the length of the strap. Coupling mechanisms 50, 52 may be fixedly or removably coupled to the strap 40. For example, an adhesive, stitching, or any other method of fixedly coupling two articles together can be used to secure the coupling mechanisms in place along the strap 40. Alternatively, the coupling mechanisms 50, 52 can be located on members that are variably locatable along the strap 40. For example, the mechanisms 50, 52 may be secured to spring clips, the position of which along the strap 40 can be adjusted.

The shade 10 is illustrated in its extended configuration in FIGS. 1–3. In this configuration, the shade 10 is substantially planar (an infinite radius of curvature) and the frame member 34 is in an extended configuration as well.

In the illustrated embodiment, the membrane 20 has a substantially oblong shape. The shape of the membrane can be a circle, a rectangle, a square or any other shape that provides protection to the user of the shade. While in one embodiment the material for membrane 20 is nylon or neoprene, any suitable material that provides some shade from a light can be used.

As shown in FIGS. 1–2, the ends 42, 44 of the strap 40 include apertures 46, 48, respectively. In an alternative embodiment of the strap 40, the strap 40 can be formed as a solid piece without any apertures.

Figure 4:
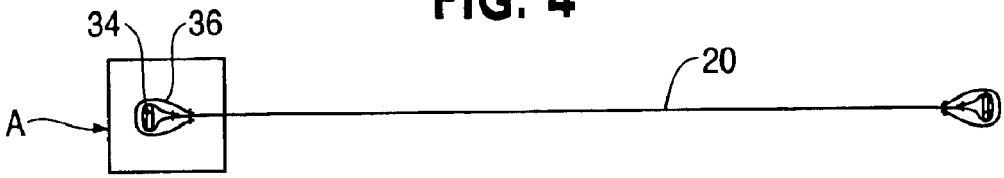
FIG. 4 illustrates a cross-sectional view of the shade of FIG. 2 along the line 4—4.

FIG. 4 illustrates a cross-sectional view of the membrane as shown in FIG. 2 along line 4—4. As shown in FIG. 4, a frame member 34 and a portion of the membrane 20 are placed within a pocket formed by a binder member 36. FIG. 4 illustrates the flexible material or frame member 34 being located along the perimeter of membrane 20.

The frame member can be, for example, a thin section of steel coil. The dimensions of the steel coil can be preselected to permit the steel coil to be collapsible as well as self-opening. As a result, the shade 10 is collapsible and self-opening.

Figure 5:
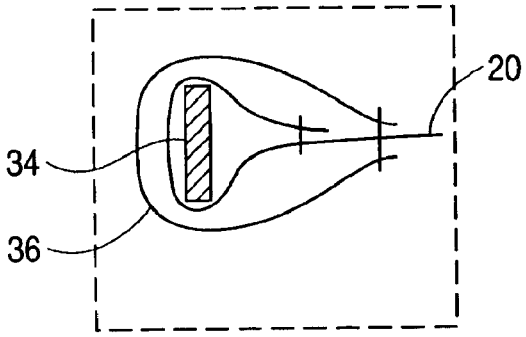
FIG. 5 illustrates an exploded view of the end portion shown in Detail A of the cross-sectional view of FIG. 4, illustrating one manner in which the shade of FIG. 1 can be constructed.

FIG. 5 illustrates an exploded view of the end portion of the cross-sectional view illustrated in FIG. 4. One manner in which the membrane of the shade illustrated in FIGS. 1–4 can be constructed, according to an embodiment of the present invention, is illustrated in FIG. 5. Membrane 20 can be folded over frame member 34 and sewn along the inner perimeter of the membrane 20. A binder member 36 can be placed around the edge of the membrane 20 and sewn as illustrated in FIG. 5. The binder member 36 can be any type of fabric.

Figure 6:
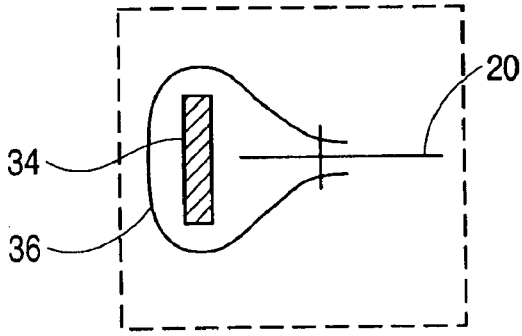
FIG. 6–7 illustrate alternative manners in which the end portion of the shade shown in Detail A of the cross-sectional view of FIG. 4 can be constructed according to embodiments of the present invention.

In an alternative manner of construction, illustrated in FIG. 6, the frame member 34 can be placed proximate to an edge of membrane 20. As shown, the frame member 34 is encapsulated by the binder member 36, the ends of which are sewn to the membrane 20.

Figure 7:
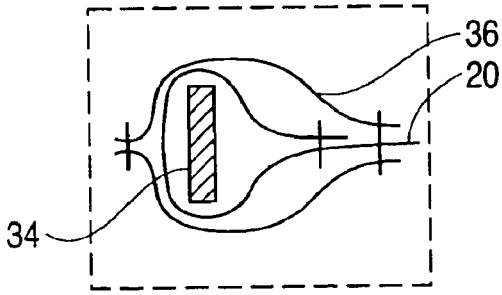

FIG. 7 illustrates another manner in which the membrane of a shade can be constructed. As illustrated, the binder member 36 is formed using two separate pieces, which are sewn together to encapsulate the end of the membrane 20 with frame member 34.

Figure 8:
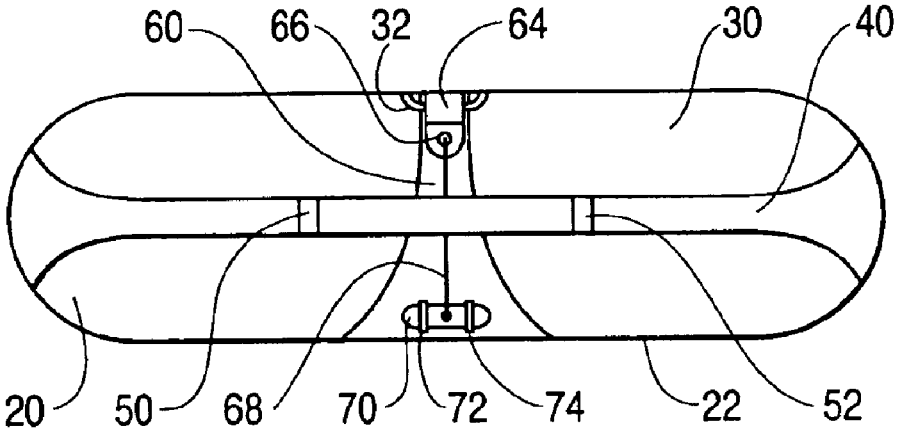
FIG. 8 illustrates a top view of an alternative embodiment of a shade according to the present invention.

An alternative embodiment of a shade is illustrated in FIG. 8. The membrane 20 includes a retaining member 32 that is connected, for example, to the inner surface 30 of the membrane 20. The retaining member 32 is positioned proximate to a perimeter edge 22 of the membrane 20. The retaining member can be loop 32 formed with two ends, each of which is connected to the membrane 20. The retaining member 32 is herein referred to as loop 32. While the loop ends can be sewn to the membrane 20, the loop ends may be connected using other methods that securely connect the loop ends to the membrane.

Shade 10 also includes a first extension member 60 that is connected to the membrane 20 proximate to the perimeter edge 22. The extension member or flap 60 can be connected, for example, to an edge of the membrane 20 that is opposite to the connection of loop 32. The first extension member 60 is herein referred to as flap 60.

The flap 60 can include two tapered or curved side edges and two ends 62, 64. End 62 is connected to the membrane 20 using, for example, sewing, knitting, stitching, or any other known method of connecting multiple pieces of material.

The other end 64 of the flap 60 includes a second extension member 68 connected thereto. In the illustrated embodiment, the second extension member 68 is a strand. The strand 68 is threaded through an eyelet 66 formed in the flap 60. The second extension member 68 is herein referred to as strand 68. One end of a strand 68 is coupled to the flap 60 in a conventional manner.

A retention or anchor member 70 is connected to the other end of the strand 68. In the illustrated embodiment, the retention or anchor member 70 is a bar. The retention member 70 is herein referred to as bar 70.

The flap 60 also includes retaining members 72, 74 connected on a surface thereof. Retaining members 72, 74 are sized to retain the bar 70 in position. In the illustrated embodiment, the retaining members 72, 74 are formed as loops. The retaining members 72, 74 are herein referred to as loops 72, 74. While loops 72, 74 can be elastic members, they can also be non-elastic members.

To position the flap 60 in its stored position as illustrated in FIG. 8, the bar 70 is fed and pulled through loop 32 so that the strand 68 and flap end 64 pass under the loop 32. The flap end 64 is then folded over loop 32. The bar 70 is then inserted into loops 72, 74, and the flap 60 is secured in its stored position. In the illustrated embodiment, the shape of bar 70 resembles the overall shape of the membrane 20. Alternatively, the bar 70 may be any shape or configuration.

Figure 9:
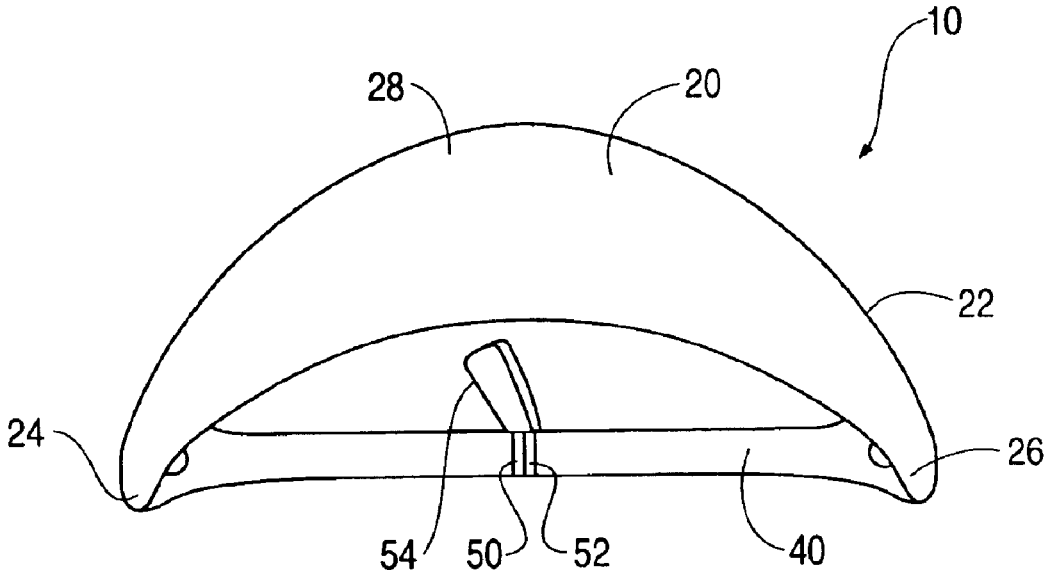
FIG. 9 illustrates a perspective view of the shade of FIG. 1 in a curved configuration.
Figure 10:
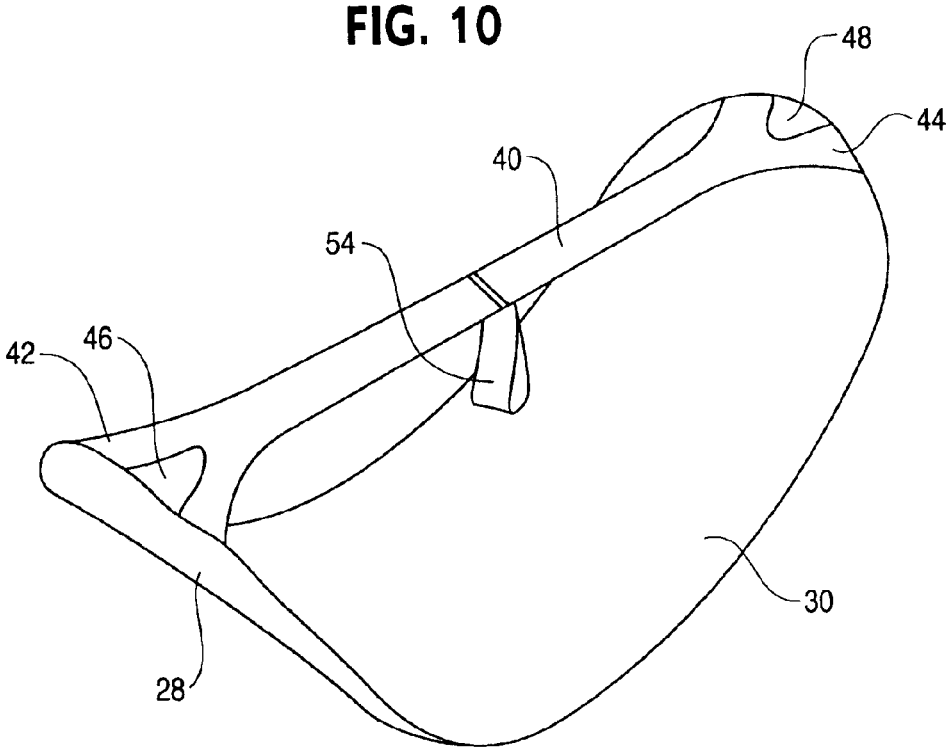
FIG. 10 illustrates another perspective view of the shade of FIG. 1 in a curved configuration.

FIGS. 9–10 illustrate different views of a shade in its curved configuration. To change the configuration of the shade 10 from its extended configuration to its curved configuration, the coupling mechanisms 50, 52 are coupled together to change the length of strap 40.

As the strap 40 is manipulated to couple the coupling mechanisms 50, 52 together, the membrane ends 24, 26 are moved closer together and the membrane 20 is moved into a curved configuration as illustrated in FIGS. 9–10. Once the coupling mechanisms 50, 52 are connected, the length of the strap 40 between them becomes excess material and forms loop 54 as shown.

When the shade 10 is in its extended configuration, the coupling mechanisms 50, 52 are spaced apart along the length of the strap 40. In an alternative embodiment, the distance between the coupling mechanisms can be varied depending on the desired curvature of the shade. For example, if the coupling mechanisms 50, 52 are mounted on variably locatable members, the distance between the coupling mechanisms 50, 52 can be changed, thereby enabling the shade 10 to have a range of curved configurations. As the distance between the coupling mechanisms 50, 52 is decreased, the radius of curvature of the shade 10 in its curved configuration increases. Similarly, as the distance increases, the radius of curvature of the shade 10 in its curved configuration decreases.

Figure 11:
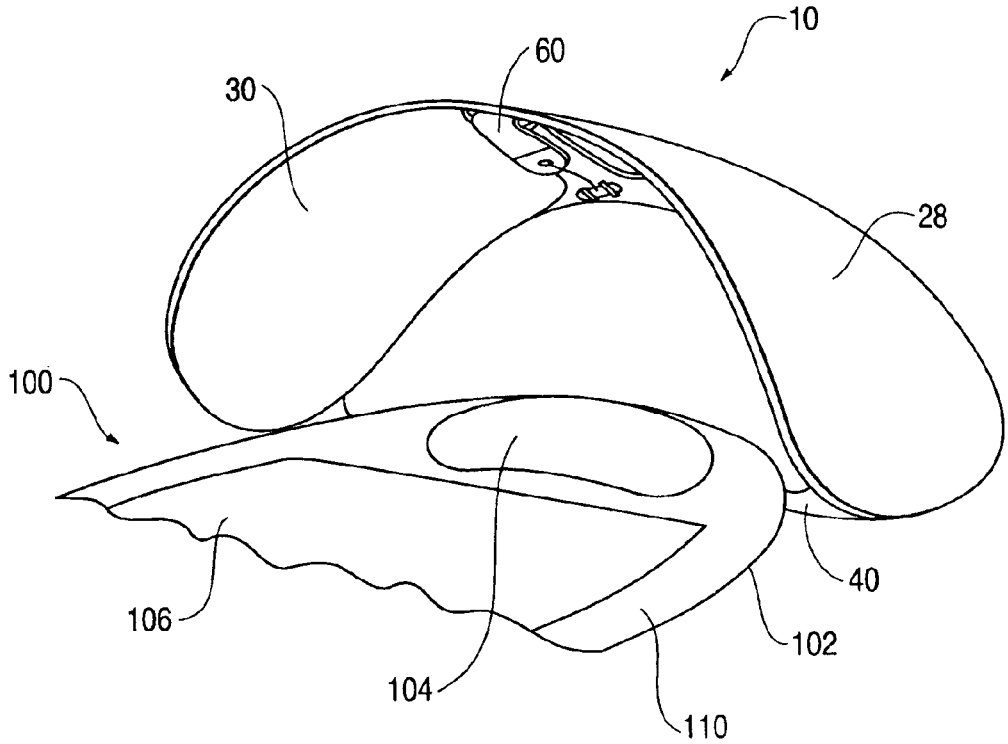
FIG. 11 illustrates a shade in combination with a towel.

A use of the shade 10 is illustrated in FIG. 11. The shade 10 is illustrated in its curved configuration. The flap 60 is maintained in its stored position on the shade 10. In the curved configuration, the shade 10 is free-standing.

In the illustrated arrangement, the strap 40 is positioned beneath a towel 100. The illustrated towel 100 includes a perimeter edge 102, a head portion 104, and a body portion 106. Any type or shape of towel or article on which a person may lie can be used with the shade. An example of a towel that may be utilized with the present invention is disclosed in U.S. patent application Ser. No. 09/229,968, entitled "Towel-Mat With a Frame Member and Removably Attached Membranes", filed Jan. 14, 1999, and which is incorporated by reference herein.

Figure 13:
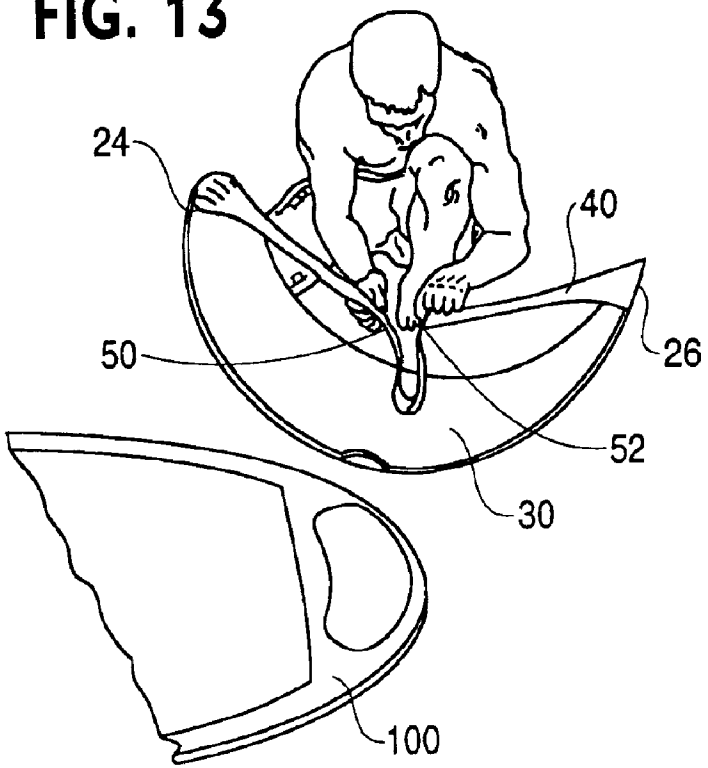
FIGS. 12–15 illustrate a process, according to an embodiment of the present invention, by which the shade can be transformed from an extended configuration to a curved configuration.
Figure 12:
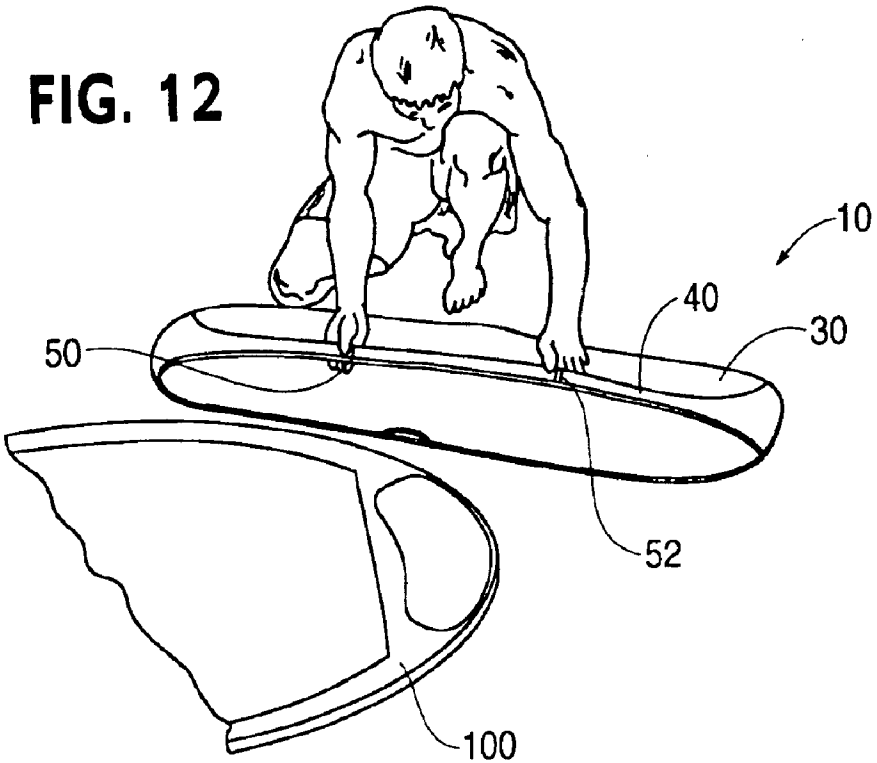

A method of using a shade is illustrated in FIGS. 12–15. As shown in FIG. 12, the shade 10 is initially positioned in a generally opened or planar configuration. The user identifies the coupling mechanisms 50, 52 and pulls them together as shown in FIG. 13. As a result, the ends 24, 26 of the membrane 20 are moved closer together and the membrane 20 takes on a curved configuration. At this point, the membrane 20 resembles a U-shaped article. The user couples the coupling mechanisms 50, 52 and turns the shade 10 over.

Figure 14:
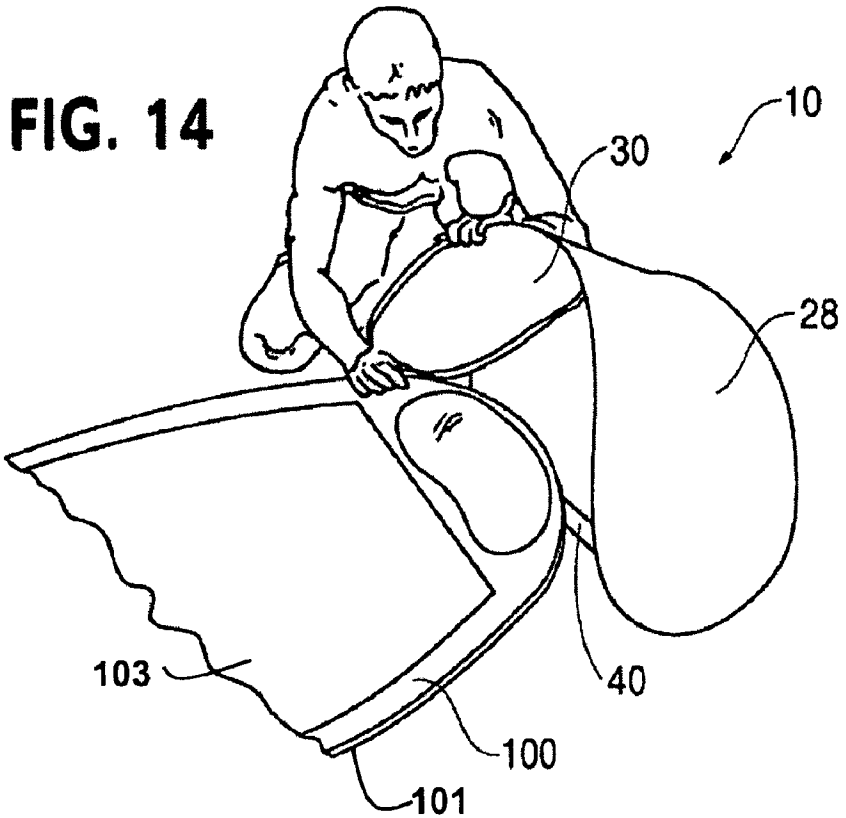

Next, the user lifts an end of a towel 100 and slides the strap 40 of the shade 10 beneath the towel 100 as shown in FIG. 14. The distance that the strap 40 is slid under the towel 100 depends on the user's preference as well as the distance between the ends 24, 26 of the membrane 20.

For example, the strap 40 may be slid a small distance under the towel 100. If the distance between the ends 24, 26 is greater than the width of the towel 100 at the location of the strap 40, a space may exist between the membrane 10 and the towel 100 on one or both sides of the towel 100. Alternatively, the strap 40 may be slid under the towel 100 as far as it can go, at which point the distance between the membrane ends 24, 26 is substantially the same as the width of the towel 100.

When the towel 100 is positioned on the strap 40, the weight of the towel biases the shade 10 into a substantially vertical position. Because the towel 100 holds the strap 40 in a generally flat or horizontal position, the membrane 20 of the shade 10 is also biased into a generally vertical position. In this arrangement, the membrane 20 is generally oriented substantially perpendicular to the support surface on which the sunshade 10 is placed.

Figure 15:
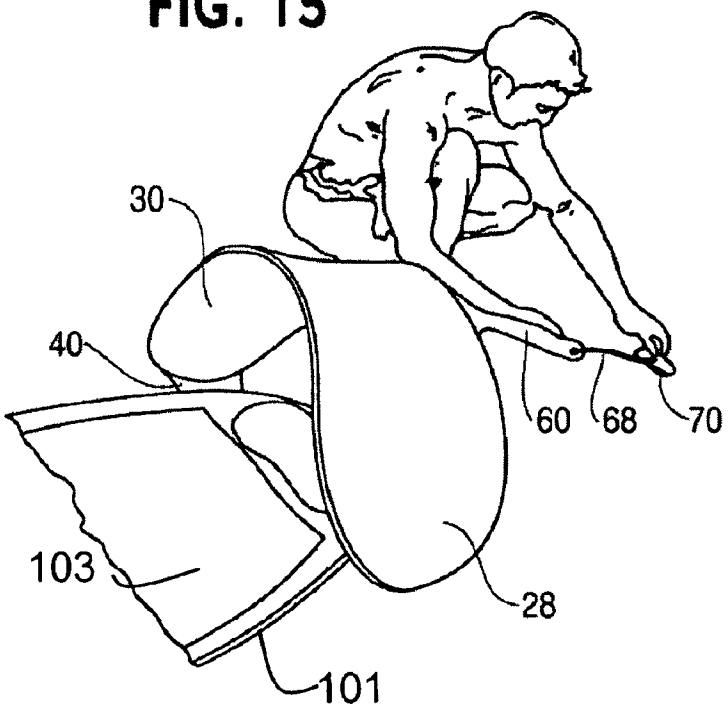

Next, the shade 10 can be tilted to a desired angle as shown in FIG. 15. Many times, the sun is not directly above a person laying in it. Usually the sun is at an angle which continuously changes. Accordingly, the user of the shade 10 may want to mount the shade 10 at an angle to provide the desired amount of protection and shade from the sunlight.

The user removes the flap 60 from the loop 32 on the membrane 20 and pulls the flap 60 rearwardly of the shade 10 as illustrated in FIG. 15. The pulling of the flap 60 and the bar 70 rearwardly counters the effect of the towel 100 on the tension strap 40. In other words, the flap 60 and bar 70 are pulled with a sufficient force to overcome the tendency of the shade 10 to remain in a vertical position due to the weight of the towel on the strap 40.

In one arrangement, the bar 70 can be forced into the sand by the user. The user can drive bar 70 into the sand as far as necessary to secure the bar 70 in place. In this arrangement, no stake is used to anchor the shade 10 in position. When the flap 60 is extended, no slack should exist on the radiused edges of the flap 60.

In an alternative arrangement, the user can use a stake (not shown) to anchor bar 70 relative to the ground or sand. Once a stake is driven into the ground or sand, the bar 70 is pulled beyond the stake to engage strand 68 with a hook or other mechanism on the stake. Because the bar 70 is wider than the strand 68, the bar 70 engages the stake and limits the movement of the strand 68 relative to the stake.

The angle at which the shade 10 is oriented with respect to a support surface is related to the distance from the strap 40 at which the bar 70 is secured to the ground. For example, as the distance between the strap 40 and the bar 70 increases, the angle at which the shade 10 is tilted relative to a free-standing configuration as shown, for example, in FIG. 11, increases. Similarly, as the distance between the strap 40 and the bar 70 decreases, the angle at which the shade 10 is tilted decreases.

In its curved configuration, the membrane 20 has a non-twisted, natural orientation. When the flap 60 is pulled rearwardly of the membrane 20, the orientation of the membrane 20 changes. The orientation of the membrane 20 changes from a non-twisted orientation to a rotated orientation, which is offset from the non-twisted orientation. The extent of the rotated orientation is determined by the distance that the flap 60 is pulled. A slight torque or twisting of the membrane 20 occurs as the flap 60 is pulled rearwardly.

The extent to which the inner surface 28 of the membrane 20 engages the perimeter edge 102 of the towel 100 relates to the angle at which the shade 10 is tilted and the shape of the towel 100. For example, if the shade 10 is in a vertical position and the towel is substantially oval, the shade 10 may contact the towel 100 along a narrow range on each side of the towel 100. As the flap 60 on the shade 10 is pulled rearwardly, however, the inner surfaces 28 of the membrane 20 becomes increasingly similar to the curvature of the towel 100.

FIGS. 16–21 illustrate a process, in ascending order, according to an embodiment of the present invention, by which a self-opening shade can be transformed from an extended configuration to a collapsed configuration. Of course, the process can be reversed to illustrate the process of transforming self-opening shade 10 from a collapsed configuration to an extended configuration by following FIGS. 16–21 in descending order.

Figure 17:
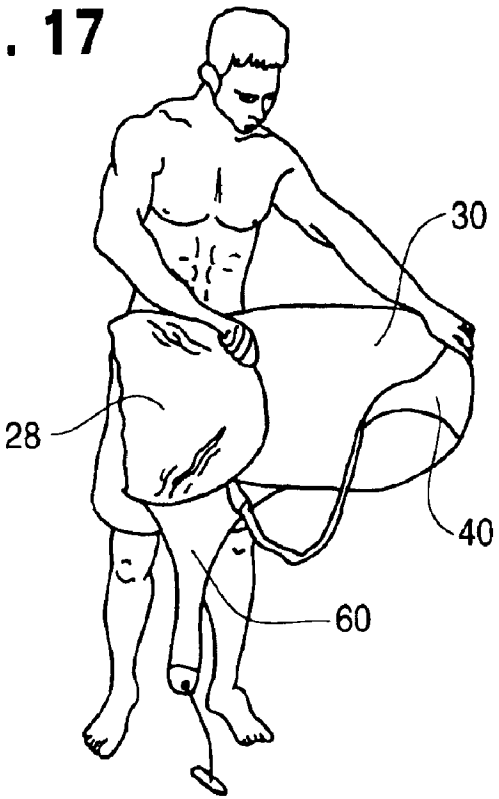
FIGS. 16–21 illustrate a process, according to an embodiment of the present invention, by which the shade can be transformed from an extended configuration to a collapsed configuration.
Figure 16:
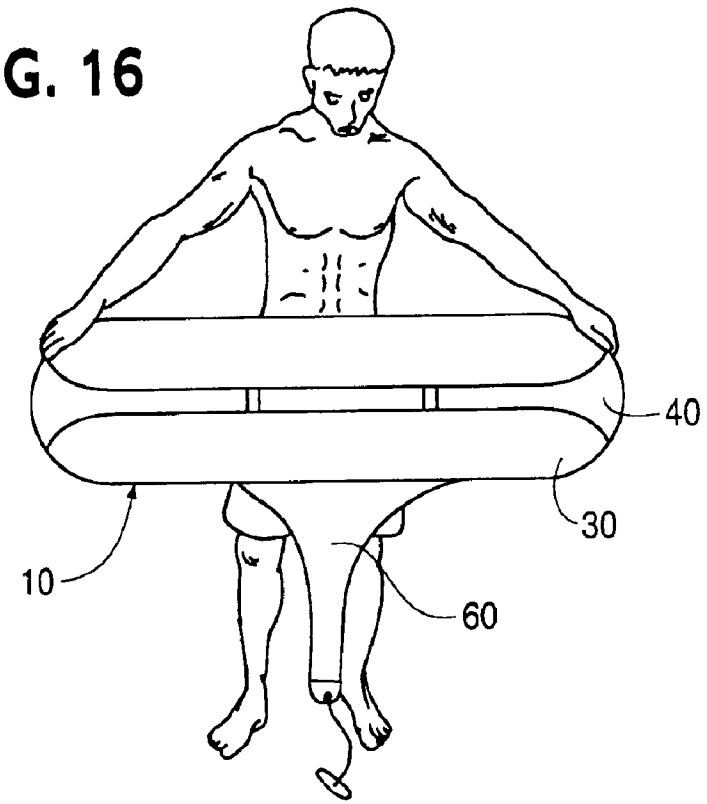
Figure 19:
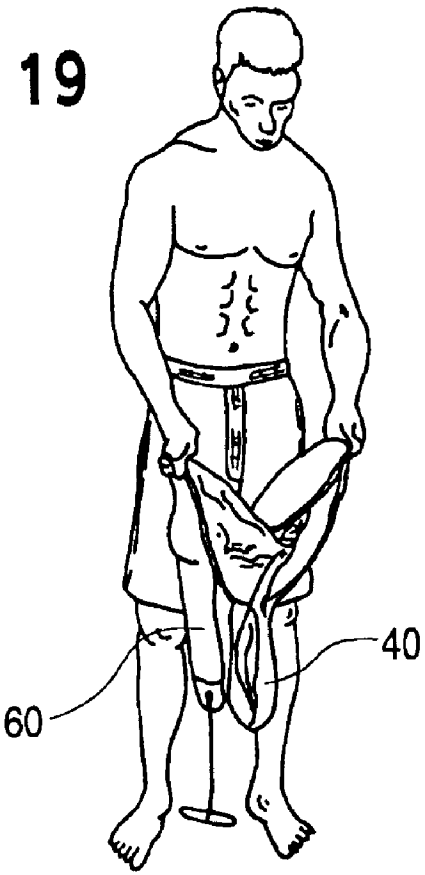
Figure 18:
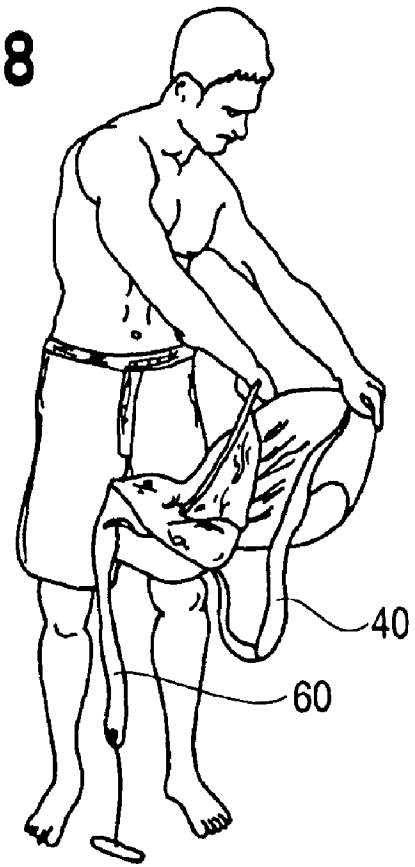

As shown in FIG. 16, where the longer side of the shade 10 lies across from 3 o'clock to 9 o'clock, a person can hold the edge of the shade 10 at approximately 2 o'clock and 10 o'clock. As shown in FIG. 17, the ends of the shade 10 along the longer side can then be folded towards the center, away from the person. As shown in FIG. 18, one end of the shade 10 can be further brought towards the center. As shown in FIG. 19, the remaining end of shade 10 can then be folded over so that shade 10 is folded into a substantially circular shape approximately one-third the area of the shade 10 when in an extended configuration as illustrated in FIG. 16.

A self-opening shade 10 in a collapsed configuration is approximately or substantially planar in shape although it does have a thickness approximately greater than the thickness of the shade as illustrated in an extended configuration. The term "substantially planar" merely indicates that the shade is approximately flat although not exactly lying within a plane in a purely geometric sense. When the shade 10 is in a collapsed configuration, the frame member 34 is in a collapsed configuration as well.

Figure 21:
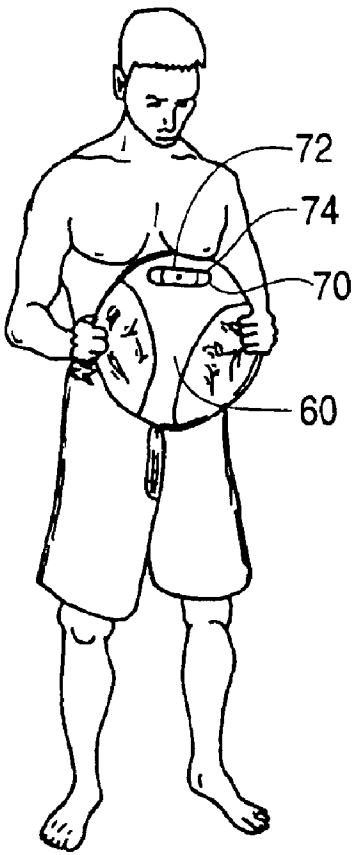
Figure 20:
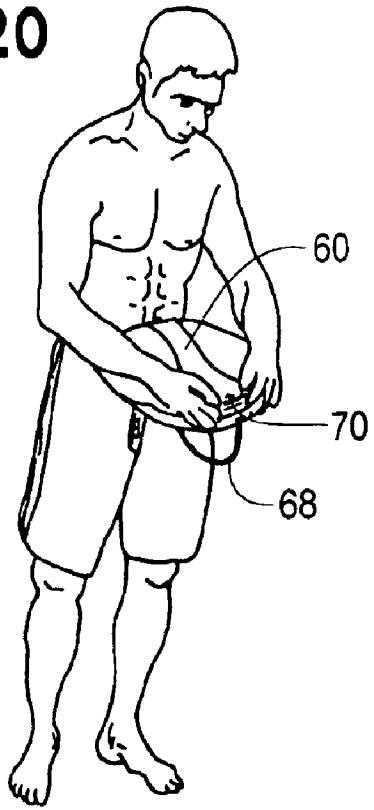

As shown in FIGS. 20–21, the flap 60 can be wrapped around the collapsed shade 10 and the bar 70 can be placed in loops 72, 74 to secure the shade 10 in its collapsed configuration.

In an alternative embodiment, the shade 10 can be placed into a carrying case (not shown) for storage and/or transport. The carrying case can include a strap and a zipper that can provide an opening to the interior portion of the case. The carrying case can be made of, for example, the same materials as the shade 10.

Figure 22:
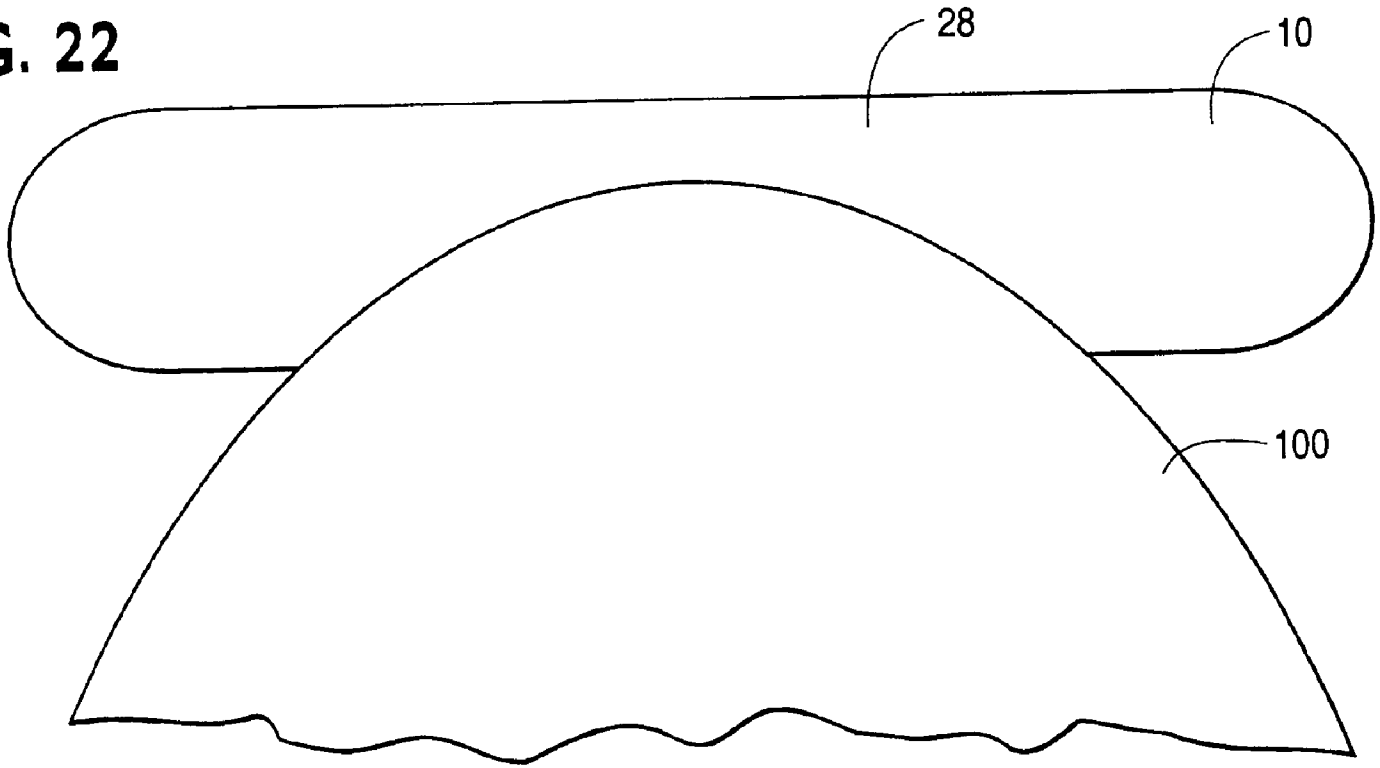
FIGS. 22–23 illustrate alternative combinations of a shade, according to an embodiment of the invention, and a towel.

An alternative use of the shade of the present invention is illustrated in FIG. 22. In the illustrated arrangement, the shade 10 is positioned in its extended configuration and laid on a supporting surface, such as ground, sand, etc. The shade 10 is slid beneath a towel 100 so that its outer surface 28 provides additional surface area for supporting articles. The shade 10 can be positioned, for example, at the head end of the towel, the foot end of the towel, or any location therebetween.

Figure 23:
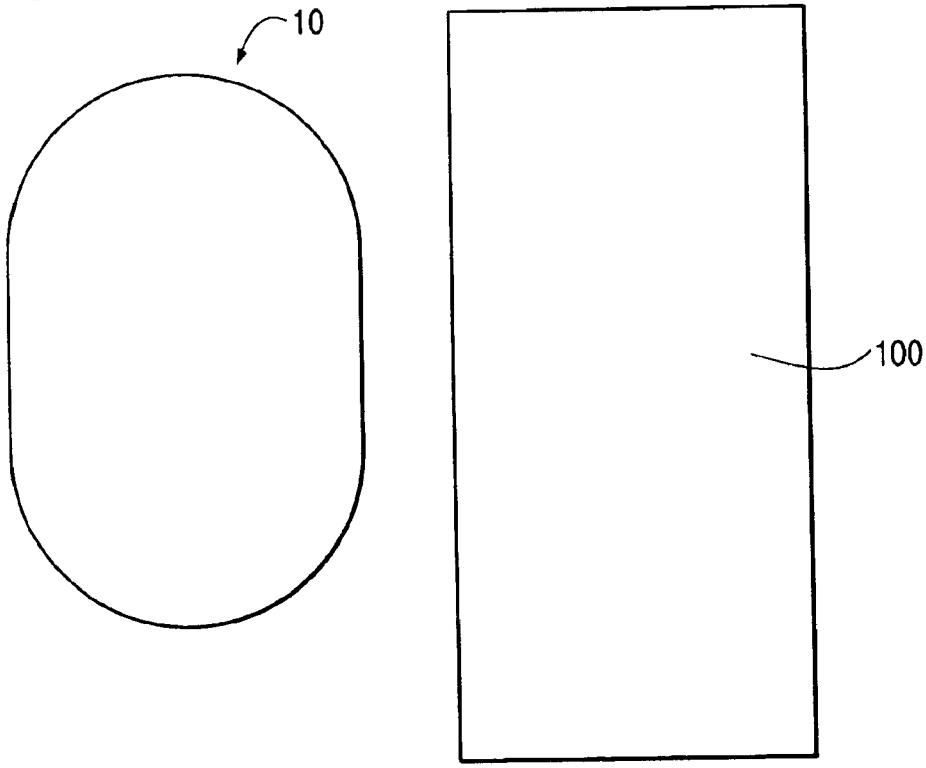

Another use of the shade is illustrated in FIGS. 14, 15 and 23. In this arrangement, the shade 10 is positioned proximate to but distanced from the towel 100. In its extended configuration, shade 10 provides additional surface area to support articles and maintain them free of sand, dirt, etc. In one embodiment, towel 100 can include a frame member 101 mounted in a membrane 103. In an alternative embodiment, the towel 100 can be a conventional towel without any frame member.

Figure 24:
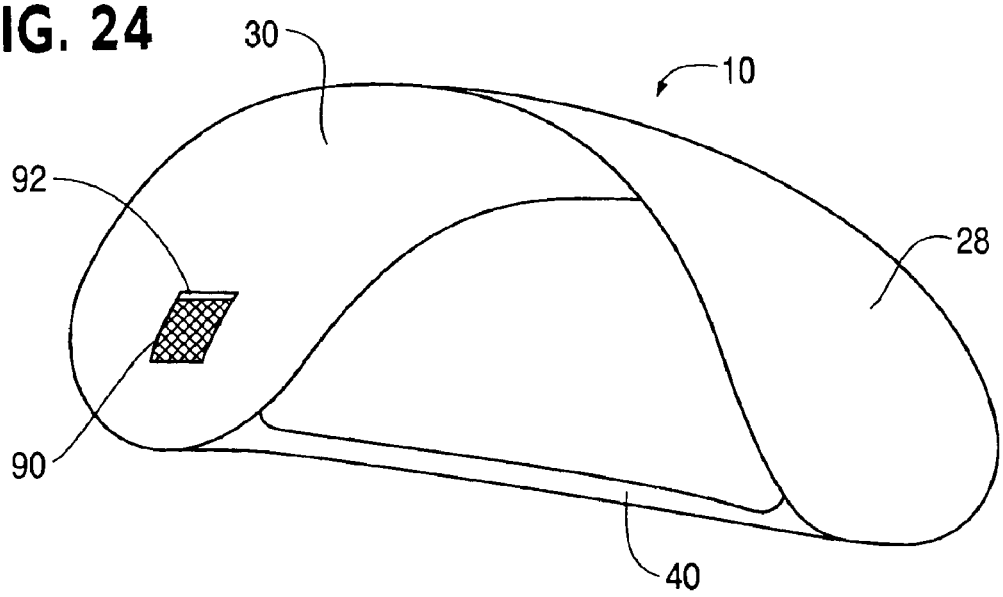
FIG. 24 illustrates an alternative embodiment of a shade according to the present invention.

An alternative embodiment of a shade is illustrated in FIG. 24. In this embodiment, the shade 10 includes a holder 90 for holding articles such as a drink, cup, sunglasses, etc.

In one embodiment, holder 90 is a piece of mesh material that is coupled on three sides to the inner surface 30 of the shade 90. The holder 90 is sewn to the membrane 20 and the open end 92 of the holder 90 is open to enable articles to be inserted therein. The open end 92 of the holder 90 may include an elastic material that secures the articles in the holder 90. While the holder can be sewn on the membrane, the holder can be coupled to the membrane using any other conventional method.

In an alternative embodiment, the holder 90 may be an insulating material that insulates a drink or other temperature sensitive article from the environmental elements. Alternatively, the shade 10 may also include multiple holders 90. Moreover, each holder 90 can be coupled to the shade 10 at any location, including the inner surface 30, the outer surface 28, and the strap 40.

Figure 25:
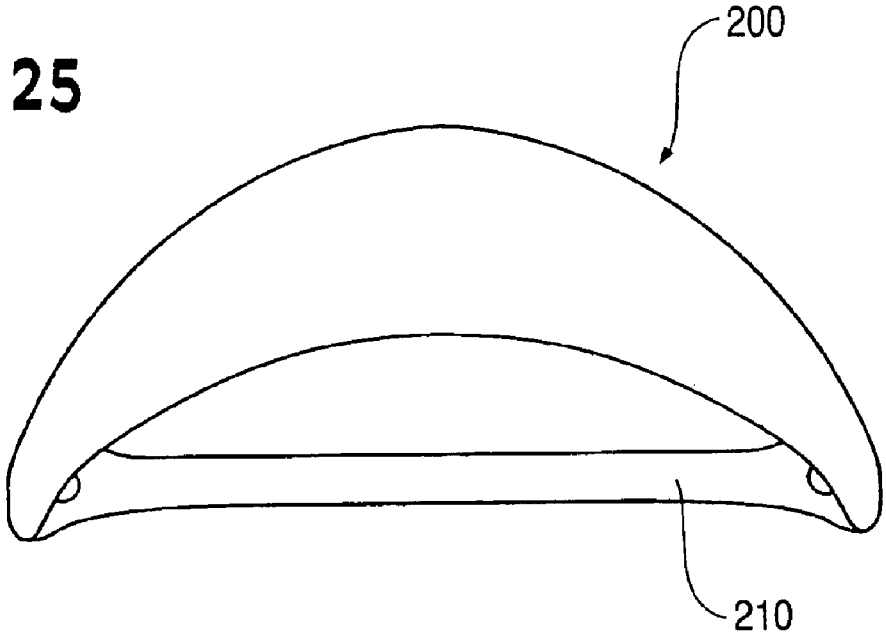
FIG. 25 illustrates an alternative embodiment of a shade according to the present invention.

An alternative embodiment of a shade is illustrated in FIG. 25. Shade 200 includes a tension member 210. In the illustrated embodiment, the tension member 210 does not have any coupling mechanisms. Since the length of the tension member 210 does not change, the shade 200 is continuously maintained in a curved configuration as illustrated. The curvature of the shade 200 is determined by the length of the tension member 210. In this embodiment, the substantially planar configuration is not necessary as the shade 10 is in either the curved configuration or the collapsed configuration. The shade 10 can be collapsed from the extended configuration by skipping the initial bending illustrated in FIG. 16.

Figure 26:
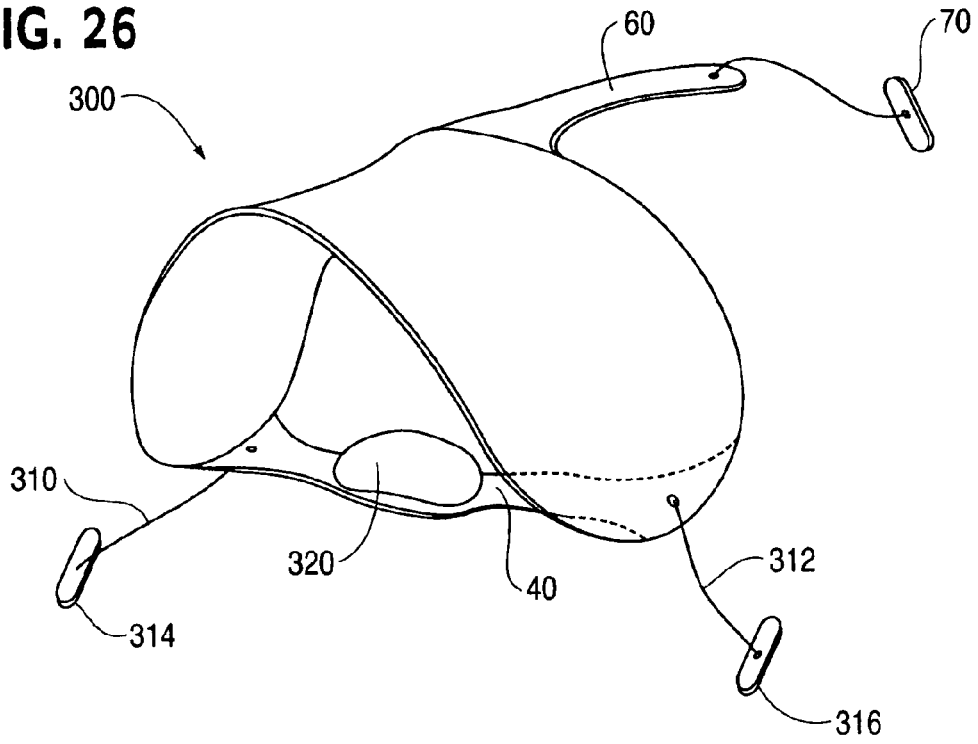
FIG. 26 illustrates an alternative embodiment of a shade according to the present invention.

Another embodiment of a shade is illustrated in FIG. 26. Shade 300 includes additional extension members 310, 312 and retention or anchor members 314, 316. Extension members 310, 312 are coupled to strap 40. The retention members or bars 314, 316 may be utilized as anchors similar to bar 70 as described above.

Because this arrangement does not utilize a towel or other article to provide weight on the strap 40, bars 314, 316 are pulled forward of the shade 10 and anchored in the sand as illustrated in FIG. 26. The anchoring effect of bars 314, 316 counteracts the effect of bar 70, which pulls the shade 10 in a rearward direction.

A head element 320 may be used with the shade 300. In one embodiment, the head element 320 is tethered to the strap 40. Alternatively, the head element 320 is releasably coupled to the strap 40 using mating hook and loop fasteners or snaps. In yet another embodiment, the head element 320 is loosely placed on the strap 40.

The head element 320 may be any shape and size. Also, the head element 320 may be formed from any material, such as foam, stuffing, etc. or may include an inflatable member.

Figure 27:
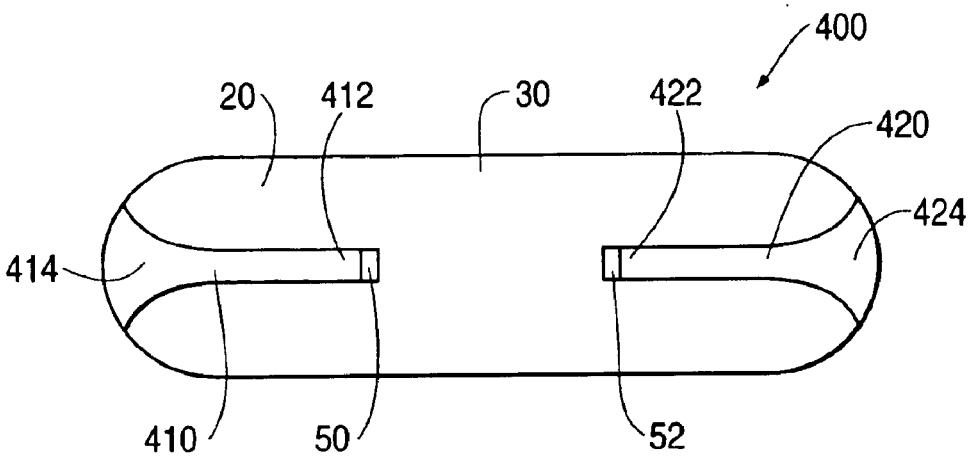
FIGS. 27–28 illustrate an alternative embodiment of a shade according to the present invention in an extended configuration and a curved configuration, respectively.
Figure 28:
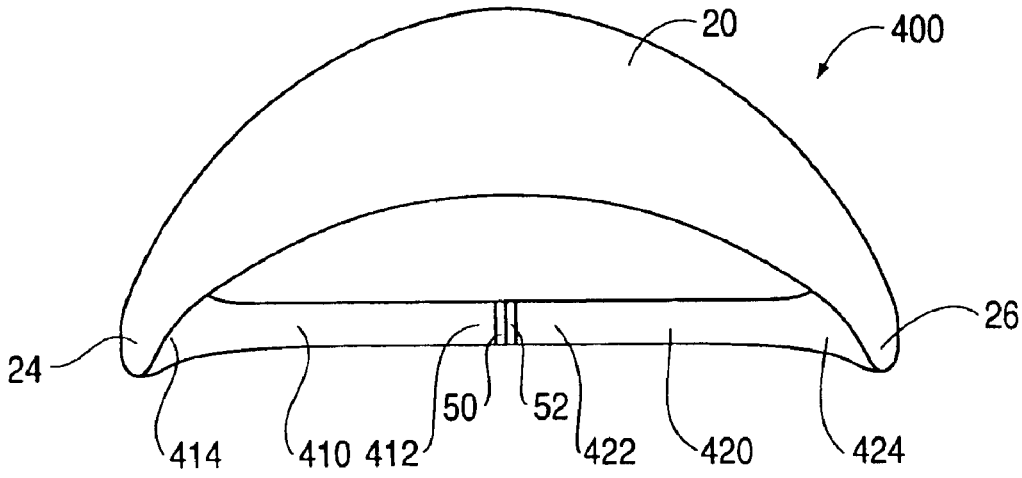

Another embodiment of a shade is illustrated in FIGS. 27–28. Shade 400 is illustrated in an extended configuration in FIG. 27 and in a curved configuration in FIG. 28.

Shade 400 includes two straps 410, 420. An end 414 of the strap 410 is connected to the membrane 20. The other end 412 of the strap 410 has a coupling mechanism 50 coupled thereto. Similarly, end 424 of strap 420 is connected to the membrane 20. The other end 422 of the strap 420 has a coupling mechanism 52 coupled thereto.

As the strands 410, 420 are pulled together, the ends 24, 26 of the membrane 20 are moved closer to each other. The coupling mechanisms 50, 52 can be coupled together to hold the membrane 20 and frame member 34 in a curved configuration.

Many possible variations on the particular embodiments described above that would be consistent with the principles of the invention. Several additional variations are described below.

The strap can include more than two coupling mechanisms. For example, two pairs of coupling mechanisms can be provided on the strap to provide a user with an option between two different curved configurations of the shade.

While the flap described above includes a strand and a bar coupled thereto, the anchoring of the flap can be accomplished using a variety of other mechanisms. For example, the strand may include a loop at its free end through which a stake can be driven. Alternatively, a stake may be driven through the eyelet of the flap, thereby eliminating the need for the strand and/or bar.

In another embodiment, the shade may include a plurality of parallel straps that are mounted to the ends of the membrane. The straps may include coupling mechanisms that enable different amounts of adjustment between the straps. As a result, the straps may have different lengths, thereby imparting an inherent twist to the shade.

In the embodiments described above, the straps function as tension members between two ends of the membrane. Anything that performs the function of tensioning two ends of the membrane is acceptable, as long as the strap and/or tension member can collapse down.

In the embodiments described above, the adjustable strap includes coupling mechanisms that are connected together to adjust the distance between the ends of the strap. The adjustable strap can include any type of adjusting mechanism or mechanisms to vary the length of the strap. For example, a buckle arrangement similar to a vehicle seat belt may be used.

What is claimed is:

1. An apparatus, comprising:

a first frame member;

a first membrane removably attachable to the first frame member;

a second membrane having a first end, a second end, and a perimeter;

a second frame member being formed from a flexible twistable material, the second frame member coupled to the second membrane, the second frame member having a first shape being substantially curved when the second frame member is in a curved configuration and a second shape being substantially planar and defines an area less than an area of the first shape when the second frame member is in a collapsed configuration;

a tension member coupled to the second membrane, the tension member being dimensioned such that the second frame member is in the curved configuration; and an extension member coupled to at least one of the tension member and the second membrane and configured to maintain an orientation of the second frame member, when the second frame member is in the curved configuration, the second frame and the second membrane together formable as an enclosure disposed over at least a portion of the first membrane.

2. The apparatus of claim 1, further comprising a plurality of coupling mechanisms including a first coupling mechanism and a second coupling mechanism, the tension member being configured to position the second frame member in the curved configuration when the first coupling mechanism is coupled to a remaining coupling mechanism from the plurality of coupling mechanisms and the second coupling mechanism is coupled to a remaining coupling mechanism from the plurality of coupling mechanisms, the second frame member being positioned in a substantially planar configuration and having an extended shape when the first coupling mechanism is not coupled to a remaining coupling mechanism from the plurality of coupling mechanisms.

3. The apparatus of claim 1, further comprising a pillow coupled to the tension member.

4. The apparatus of claim 1, further comprising an inflatable pillow coupled to the tension member.

5. An apparatus, comprising:

a first frame member;

a first membrane removably attachable to the first frame member;

a second membrane having a first end, a second end, and a perimeter;

a second frame member being formed from a flexible twistable material, the second frame member coupled to the second membrane along the membrane perimeter, the second frame member having a first shape being substantially curved when the second frame member is in a curved configuration and a second shape being substantially planar and having an area less than an area of the first shape when the second frame member is in a collapsed configuration;

a plurality of coupling mechanisms including a first coupling mechanism and a second coupling mechanism;

a tension member coupled proximate to the first end and the second end of the second membrane, the tension member being configured to position the second frame member in the curved configuration when the first coupling mechanism is coupled to a remaining coupling mechanism from the plurality of coupling mechanisms and the second coupling mechanism is coupled to a remaining coupling mechanism from the plurality of coupling mechanisms, the second frame member being positioned in a substantially planar configuration and having an extended shape when the first coupling mechanism is not coupled to a remaining coupling mechanism from the plurality of coupling mechanisms; and an extension member coupled to at least one of the tension member and the second membrane and configured to maintain an orientation of the apparatus, when the second frame member is in the curved configuration, the second frame member and the second membrane together formable as an enclosure disposed over at least a portion of the first membrane.

6. The apparatus of claim 5, further comprising a pillow coupled to the tension member.

7. An apparatus, comprising:

a first frame member;

a first membrane removably attachable to the first frame member;

a second membrane having a first end, a second end, and a perimeter;

a second frame member being formed from a flexible twistable material, the second frame member coupled to the second membrane along the membrane perimeter, the second frame member having a first shape being substantially curved when the second frame member is in a curved configuration, and a second shape being substantially planar and having an area less than an area of the first shape when the second frame member is in a collapsed configuration;

a tension member coupled proximate to the first end and the second end of the second membrane such that the second frame member is maintained in the first shape;

a pillow coupled to the tension member; and an extension member coupled to at least one of the tension member and the second membrane and configured to maintain an orientation of the apparatus when the second frame member is in the curved configuration, the second frame and the second membrane together formable as an enclosure disposed over at least a portion of the first membrane.

8. The apparatus of claim 7, wherein the tension member is configured to provide a tension coupling that defines the shape of the curved configuration of the second frame member.

9. The apparatus of claim 7, further comprising a plurality of coupling mechanisms including a first coupling mechanism and a second coupling mechanism, the first coupling mechanism and the second coupling mechanism each being coupleable to remaining coupling mechanisms from the plurality of coupling mechanisms to change the distance between the second membrane first end and the second membrane second end.

10. The apparatus of claim 7, wherein the tension member has a first side connected proximate to the second membrane first end and a second side connected proximate to the second membrane second end.

11. The apparatus of claim 7, wherein the second frame member can be positioned in a first curved configuration with a first radius of curvature and a second curved configuration with a second radius of curvature, the first radius of curvature being different from the second radius of curvature.

12. A method, comprising:

opening a collapsible device into an extended configuration, the collapsible device including a first frame member and a first membrane attachable to the first frame member;

opening a sunshade into an extended configuration, the sunshade including a second membrane, a second frame member coupled to the second membrane, a tension member coupled to the second membrane, a plurality of coupling mechanisms including a first coupling mechanism and a second coupling mechanism;

coupling the first coupling mechanism to a remaining coupling mechanism from the plurality of coupling mechanisms;

coupling the second coupling mechanism to a remaining coupling mechanism from the plurality of coupling mechanisms, the coupling of the first coupling mechanism and the second coupling mechanism to remaining coupling mechanisms urging the sunshade into a curved configuration; and coupling an extension member to the tension member and the second membrane, the extension member configured to maintain an orientation of the sunshade above the collapsible device.

13. The method of claim 12, further comprising inflating an inflatable pillow coupled to the tension member.

* * * * *